US008801532B2

(12) United States Patent
Katayama

(10) Patent No.: US 8,801,532 B2
(45) Date of Patent: Aug. 12, 2014

(54) GOLF SWING MEASUREMENT DEVICE AND GOLF SWING MEASUREMENT SYSTEM

(75) Inventor: Shu Katayama, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 1490 days.

(21) Appl. No.: 12/071,447

(22) Filed: Feb. 21, 2008

(65) Prior Publication Data

US 2008/0287205 A1 Nov. 20, 2008

(30) Foreign Application Priority Data

May 17, 2007 (JP) ..... 2007-131417

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |

(52) U.S. Cl.

USPC ..... 473/222; 473/151; 473/219; 473/221; 473/225; 473/233; 473/257; 473/405

(58) Field of Classification Search

USPC ..... 473/151, 219, 221, 222, 225, 233, 257, 473/405

See application file for complete search history.

(56) References Cited

U.S. PATENT DOCUMENTS

| | | | | | |
|---|---|---|---|---|---|
| 4,844,469 | A | * | 7/1989 | Yasuda et al. | 473/225 |
| 5,108,105 | A | * | 4/1992 | Shimizu | 473/225 |
| 5,114,150 | A | * | 5/1992 | Matsumura | 473/222 |
| 5,257,084 | A | * | 10/1993 | Marsh | 356/28 |
| 5,401,026 | A | * | 3/1995 | Eccher et al. | 473/199 |
| 5,472,205 | A | * | 12/1995 | Bouton | 473/222 |
| 5,728,006 | A | * | 3/1998 | Teitell et al. | 473/151 |
| 5,803,823 | A | * | 9/1998 | Gobush et al. | 473/223 |
| 5,826,874 | A | * | 10/1998 | Teitell et al. | 473/225 |
| 5,926,780 | A | * | 7/1999 | Fox et al. | 702/142 |
| 5,935,014 | A | * | 8/1999 | Lindsay | 473/222 |

(Continued)

FOREIGN PATENT DOCUMENTS

| | | |
|---|---|---|
| JP | 62-22175 A | 1/1987 |
| JP | 02-107277 | 4/1990 |
| JP | 05-232130 | 9/1993 |

(Continued)

OTHER PUBLICATIONS

Notice of Reason for Rejection for Japanese Patent Application 2007-131417, Japanese Patent Office, Nov. 8, 2011.

*Primary Examiner* — Lawrence Galka

(74) *Attorney, Agent, or Firm* — Kubotera & Associates, LLC

(57) ABSTRACT

A golf swing measurement device is placed in front of a golfer when the golfer swings a golf club to hit a golf ball. The golf swing measurement device includes a sidewall portion extending substantially in parallel to a swing path of the club head; a first sensor coil and a second sensor coil disposed along the sidewall portion for detecting a club head with a permanent magnet on a distal thereof passing therethrough; a calculation unit for calculating a swing time from a start moment of a backswing to a moment of an impact, a head speed upon the impact, and a total flying distance; a display unit for displaying the swing time, the head speed, and the total flying distance; a memory unit for storing measurement data including the swing time, head speed, and the total flying distance; and a transmission unit for sending the measurement data.

13 Claims, 11 Drawing Sheets

(56) References Cited

U.S. PATENT DOCUMENTS

| | | | | |
|---|---|---|---|---|
| 6,042,483 | A | 3/2000 | Katayama | |
| 6,437,559 | B1 * | 8/2002 | Zajac et al. | 324/179 |
| 6,458,035 | B1 | 10/2002 | Katayama | |
| 6,742,385 | B2 | 6/2004 | Katayama | |
| 7,273,427 | B2 | 9/2007 | Inoue et al. | |
| 7,815,516 | B1 * | 10/2010 | Mortimer et al. | 473/257 |
| 7,837,572 | B2 * | 11/2010 | Bissonnette et al. | 473/151 |
| 2005/0272514 | A1 * | 12/2005 | Bissonnette et al. | 473/151 |

FOREIGN PATENT DOCUMENTS

| | | |
|---|---|---|
| JP | 11-057105 | 3/1999 |
| JP | 11-290496 | 10/1999 |
| JP | 2001-314540 | 11/2001 |
| JP | 2002-224259 A | 8/2002 |
| JP | 2003-126321 | 5/2003 |

* cited by examiner

GOLF SWING MEASUREMENT DEVICE AND GOLF SWING MEASUREMENT SYSTEM

BACKGROUND OF THE INVENTION AND RELATED ART STATEMENT

The present invention relates to a golf swing measurement device and a golf swing measurement system for measuring and calculating measurement data such as a swing time from a start moment of a backswing of a golf club to a moment of an impact on a golf ball, a head speed of the golf club upon the impact, and a total flying distance, so that the measurement data can be displayed. According to the present invention, the golf swing measurement device is capable of storing the measurement data and forwarding the measurement data thus stored to a personal computer and the likes. Accordingly, it is possible to use the measurement data for analyzing a golf swing at an arbitrary location, thereby assisting a golfer to improve skills.

Patent Reference discloses a conventional golf swing measurement device. The conventional golf swing measurement device measures a swing time from a start moment of backswing of a golf club to a moment of an impact on a golf ball (referred to as a swing time), and a head speed upon the impact (referred to as a head speed).

In the conventional golf swing measurement device, a first sensor coil and a second sensor coil are arranged to be substantially parallel to a swing path of a golf club head. Further, a permanent magnet is attached to a distal end portion of a golf club head. Accordingly, when the golf club is swung, the first sensor coil and the second sensor coil detect the club head passing therethrough, and a detection signal is sent. With the configuration described above, it is possible to calculate the swing time and the head speed according to the detection signal of the first sensor coil and the second sensor coil.

Patent Reference: Japanese Patent Publication No. 11-290496

With the conventional golf swing measurement device disclosed in Patent Reference, a golfer measures the swing time and the head speed at a place such as a driving range where the golfer swings a golf club. Accordingly, it is possible to utilize measurement data on the spot of practice. However, it is difficult to analyze the golf swing using the measurement data at such a place as a home other than a driving range. Further, with the conventional golf swing measurement device, it is difficult to measure an index value associated with the golf swing other than the swing time and the head speed.

In view of the problems described above, an object of the present invention is to provide a golf swing measurement device capable of analyzing a golf swing using measurement data at such a place as a home other than a driving range, as well as measuring the swing time and the head speed at such a place as a driving range where a golfer swings a golf club.

Further, with the golf swing measurement device of the present invention, it is possible to calculate and display an index value associated with the golf swing in addition to the swing time and the head speed. Accordingly, it is possible to provide the golf swing measurement device capable of utilizing the measurement data of the golf swing more effectively, thereby improving skills in the golf swing.

Further objects and advantages of the invention will be apparent from the following description of the invention.

SUMMARY OF THE INVENTION

In order to attain the objects described above, according to the present invention, a golf swing measurement device has a box shape, and is placed in front of a golfer when the golfer swings a golf club to hit a golf ball. The golf swing measurement device includes:

a sidewall portion extending substantially in parallel to a swing path of the club head;

a first sensor coil disposed along the sidewall portion and a second sensor coil disposed along the sidewall portion at a front position of a swing path with respect to the first sensor coil by a specific distance for detecting a club head with a permanent magnet on a distal thereof passing therethrough;

a calculation unit for calculating a swing time from a start moment of a backswing to a moment of an impact, a head speed upon the impact, and a total flying distance according to a detection signal of the first sensor coil and the second sensor coil;

a display unit for displaying the swing time, the head speed, and the total flying distance;

a memory unit for storing measurement data including the swing time, head speed, and the total flying distance for a plurality of swings; and a transmission unit for sending the measurement data stored in the memory unit to a personal computer when a specific operation is executed in the golf swing measurement device or an instruction is sent from the personal computer.

According to the present invention, the golf swing measurement device has the memory unit for storing the measurement data and the transmission unit for sending the measurement data stored in the memory unit to the personal computer. Accordingly, it is possible to analyze the golf swing using the measurement data at such a place as a home other than a driving range with software of the personal computer through sending the measurement data from the golf swing measurement device to the personal computer.

Further, with the golf swing measurement device of the present invention, it is possible to calculate the total flying distance (an estimated value of the total flying distance). Accordingly, it is possible to measure an index value relating to the golf swing other than the swing time and the head speed.

In the golf swing measurement device of the present invention, it is preferred that the display unit displays each of the head speed, the total flying distance, and the swing time for a specific period of time in this sequence. Then, the display unit displays the head speed and stops changing the display. Accordingly, it is possible for the golfer to confirm whether the swing is measured.

The measurement data such as the head speed often can be the same in a plurality of golf swings. That is, when a numerical value such as the head speed is independently displayed, it is difficult to tell whether the numerical value is the same even though the measurement is properly conducted or the measurement is not conducted.

In the golf swing measurement device of the present invention, it is preferred that the first sensor coil and the second sensor coil area arranged away from each other by a distance between 50 and 100 mm. Accordingly, it is possible to accurately measure the head speed immediately before the impact.

More specifically, when the distance is less than 50 mm, it is necessary to measure the head speed in a shorter period of time, thereby increasing a measurement error. On the other hand, when the distance is longer than 100 mm, the head speed is further accelerated toward the impact. Accordingly, a slower head speed is measured instead of an actual head speed immediately before the impact.

In the golf swing measurement device of the present invention, it is preferred that the memory unit stores the measurement data such as the swing time, the head speed, and the total flying distance for 10 to 200 swings, more preferably 70 to 130 swings. Accordingly, it is easy for the golfer to handle the measurement data stored in the memory unit.

In general, a golfer shoots an average of 100 to 150 balls for practice at a driving range or the like. It is presumed that the golfer shoots an average of 70 to 120 balls for practice after warm-up. Accordingly, when data of less than 70 swings are stored, an analysis of the data may be restricted due to the limited amount. On the other hand, when the data of more than 130 swings are stored, the data may become too large for the golfer to recall the swings thereof.

In the golf swing measurement device of the present invention, it is preferred that the calculation unit calculates the swing path according to the detection signal of the first sensor coil and the second sensor coil, so that the swing path can be classified into an outside-in, a straight-through, or an inside-out. Then, the display unit displays the classification of the swing path. Accordingly, it is possible to provide the golfer with a suggestion on a habit or fault of the swing thereof.

In this case, due to a limited space of the display unit, it is preferred that the display unit displays each of the head speed, the total flying distance, and the swing time for a specific period of time in this sequence. Then, the display unit displays the head speed and stops changing the display. It is preferred that the display unit displays the swing path with an icon in another space thereof after the measurement.

In the golf swing measurement device of the present invention, it is possible to analyze the golf swing using the measurement data at such a place as a home other than a driving range, as well as to measure the swing time, the head speed, and the total flying distance at such a place as a driving range where the golfer swings the golf club. Accordingly, it is possible to utilize the measurement data of the golf swing more effectively, thereby improving skills in the golf swing. In the golf swing measurement device according to the present invention, it is possible to measure, calculate, and display the total flying distance, i.e., an index value related to the golf swing, in addition to the swing time and the head speed.

DETAILED DESCRIPTION OF PREFERRED EMBODIMENTS

Hereunder, embodiments of the present invention will be explained with reference to the accompanying drawings. Note that the present invention is not limited to the following embodiments.

First Embodiment

Figure 1:
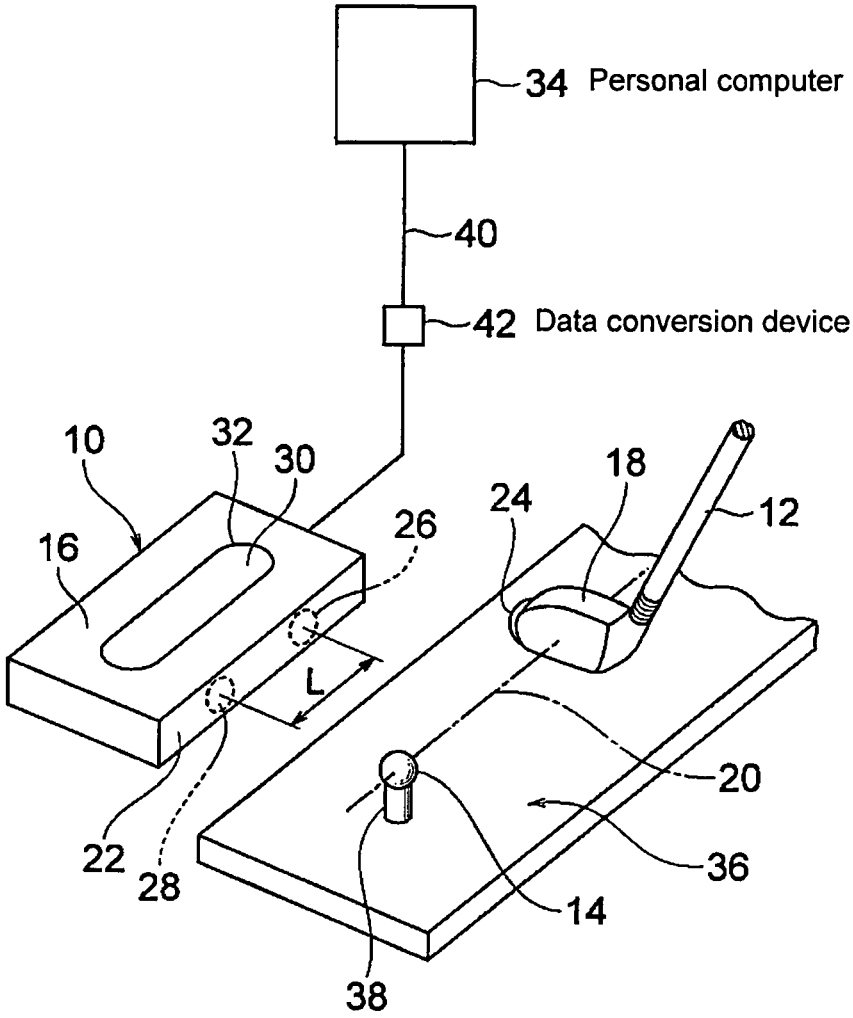
FIG. 1 is a schematic view showing a golf swing measuring system using a golf swing measurement device according to a first embodiment of the present invention.
Figure 2:
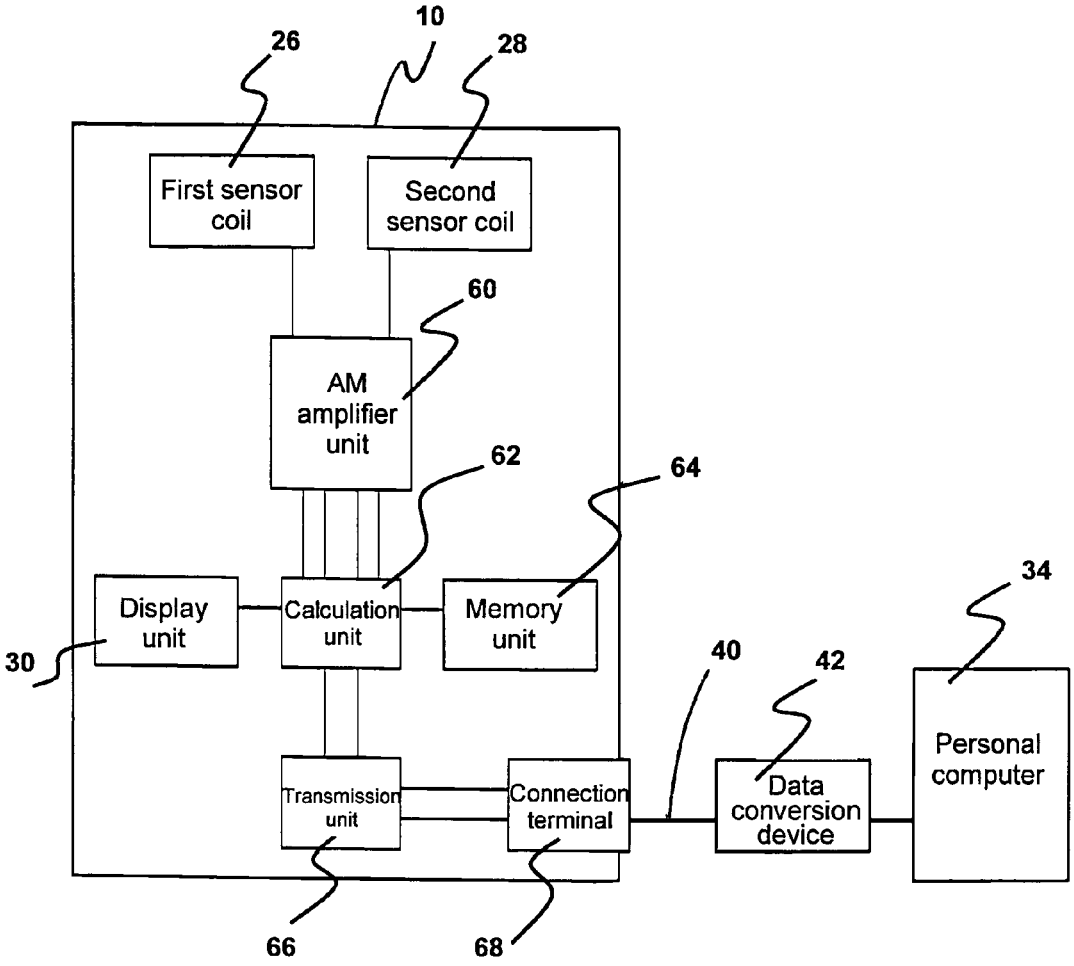
FIG. 2 is a block diagram showing the golf swing measurement device according to the first embodiment of the present invention.
Figure 3:
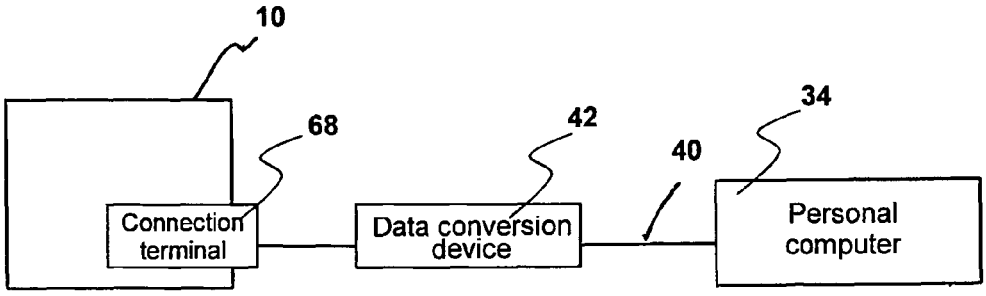
FIG. 3 is a block diagram showing the golf swing measurement device according to the first embodiment of the present invention.

A first embodiment of the present invention will be explained. A configuration of the swing measurement device will be explained first. FIG. 1 is a schematic view showing a golf swing measuring system using a golf swing measurement device 10 according to an embodiment of the present invention. FIG. 2 is a block diagram showing the golf swing measurement device 10 according to the first embodiment of the present invention. FIG. 3 is a block diagram showing the golf swing measurement device according to the first embodiment of the present invention.

As shown in FIG. 1, the golf swing measurement device 10 has a box shape. The golf swing measurement device 10 is placed in front of a golfer when the golfer swings a golf club 12 to hit a golf ball 14.

In the embodiment, the golf swing measurement device 10 has a housing 16 made of a plastic having a rectangular shape. The housing 16 accommodates a first sensor coil 26 and a second sensor coil 28 therein. The first sensor coil 26 and the second sensor coil 28 are arranged along a sidewall portion 22 extending substantially in parallel to a swing path 20 of a club head 18.

In the embodiment, the club head 18 has a permanent magnet 24 on a distal thereof. When the golf club 18 passes through nearby the first sensor coil 26, the first sensor coil 26 detects the club head 18. The second sensor coil 28 is disposed on a front side of a swing path at a specific distance from the first sensor coil 26, and detects the club head 18 in a similar manner to that of the first sensor coil 26. The first sensor coil 26 and the second sensor coil 28 are arranged along the sidewall portion 22 of the housing 16 at positions separated from each other by a distance L.

In the embodiment, the sidewall portion 22 of the golf swing measurement device 10 is positioned substantially in parallel to the swing path 20. The swing path 20 is a path of the club head 18 of the golf club 12 when the golf club 12 is swung to hit the ball 14, as described above. The first sensor coil 26 and the second sensor coil 28 are arranged, so that center axes of the first sensor coil 26 and the second sensor coil 28 face a direction substantially perpendicular to the swing path 20.

In the embodiment, the distance L of the sensor coils 26 and 28 is set to be 70 mm, preferably in a range of 50 to 100 mm. Further, the second sensor coil 28 is placed on a right side of a tee 38 at a distance of 90 mm, preferably in a range of 70 to 120 mm, in a swing path direction.

In the embodiment, the golf swing measurement device 10 further includes a display unit 30 on a top wall portion 32 of the housing 16. The display unit 30 displays each of a head speed, a total flying distance, and a swing time in a numerical value for a specific period of time in this sequence. Then, the display unit 30 displays the head speed and stops changing the display. Further, the display unit 30 displays the swing path 20 with an icon in a different space thereof after measurement.

As shown in FIG. 2, in addition to the first sensor coil 26, the second sensor coil 28, and the display unit 30, the golf swing measurement device 10 includes an amplifier unit 60; a calculation unit 62; a memory unit 64; a transmission unit 66; and a connection terminal 68.

In the embodiment, the amplifier unit 60 is disposed inside the housing 16 for amplifying a small signal detected with the first sensor coil 26 and the second sensor coil 28. Then, the amplifier unit 60 generates a signal based on the small signal, so that the calculation unit 62 calculates the signal thus generated.

In the embodiment, the calculation unit 62 is disposed inside the housing 16 for electrically connecting with the first sensor coil 26 and the second sensor coil 28 through the amplifier unit 60. The calculation unit 62 calculates the swing time, the head speed, and the total flying distance (an estimated value) based on the detection signal detected with the first sensor coil 26 and the second sensor coil 28. Further, the calculation unit 62 determines the swing path and classifies the swing path into an outside-in, a straight-through, or an inside-out. The swing time, the head speed, the total flying distance, and the swing path are determined with an appropriate calculation method.

In the embodiment, the memory unit 64 is disposed inside the housing 16, and is electrically connected with the calculation unit 62. The memory unit 64 stores measurement data for a plurality of swings (10 to 200 swings, more preferably 70 to 130 swings). The measurement data include the swing time, the head speed, the total flying distance, and the swing path.

In the embodiment, the transmission unit 66 is disposed inside the housing 16 for sending the measurement data stored in the memory unit to a personal computer 34 when a specific operation is executed in the golf swing measurement device 10 or an instruction is transmitted from the personal computer 34.

In the embodiment, the connection terminal 68 is provided for externally retrieving the measurement data sent from the transmission unit 66. When the measurement data is retrieved externally, a transmission signal cable is connected to the connection terminal 68. A reception signal cable may be connected to the connection terminal 68 for receiving a signal from outside, thereby enabling communication. Depending on a type of communication, a specific conversion device may be connected to the connection terminal 68 (described later).

In the embodiment, the golf swing measurement device 10 may further include a variety of operation buttons, a crystal element for measuring a period of time, and the likes (not shown).

In the embodiment, when all of the measurement data is displayed on the display unit 30, it is difficult to visually recognize all of the measurement data due to a limited display area of the display unit 30. To this end, the golf swing measurement device 10 is configured to display only essential information on the display unit 30, and to send the measurement data externally for displaying more detailed information and further analysis at an external device such as the personal computer 34.

In the embodiment, the transmission unit 66 sends the measurement data in a simple format, for example, a serial signal, in which a voltage changes with time. A specific communication cable is adopted as an interface to connect the golf swing measurement device 10 to a corresponding external device. Accordingly, it is possible to connect the golf swing measurement device 10 to various types of devices through changing a configuration of the communication cable.

More specifically, when the golf swing measurement device 10 is connected to the personal computer 34 or a personal digital assistant (PDA), a universal serial bus (USB) is used as the interface. In this case, a data conversion device 42 (described later) is adopted.

Figure 4:
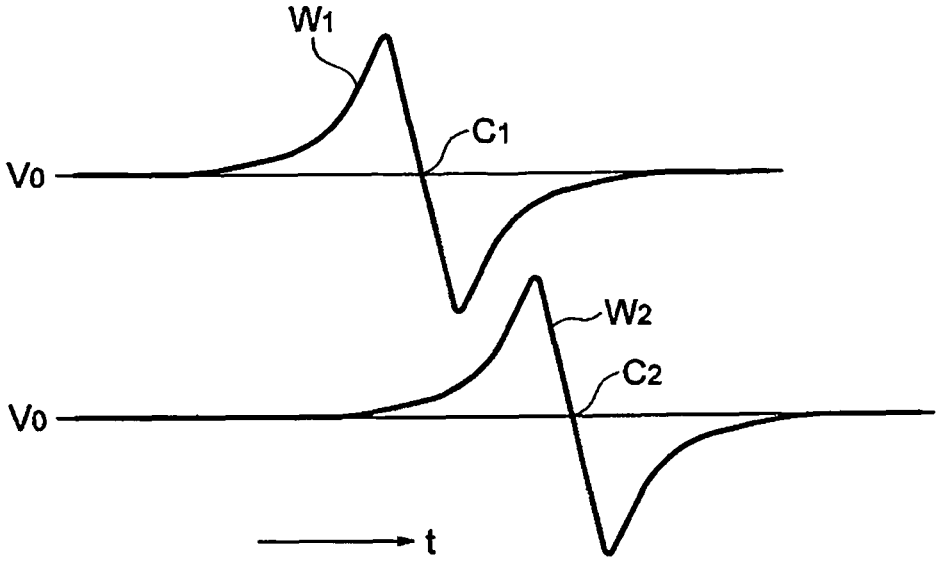
FIG. 4 is a graph showing wave patterns of induced electromotive forces generated in a first sensor coil and a second sensor coil according to the first embodiment of the present invention.

FIG. 4 is a graph showing wave patterns W1 and W2 of induced electromotive forces generated in the first sensor coil 26 and the second sensor coil 28 according to the first embodiment of the present invention.

As shown in FIG. 4, in the golf swing measurement device 10, when the golf club 12 moves along the swing path 20 and the permanent magnet 24 attached to the club head 18 passes in front of the first sensor coil 26 and the second sensor coil 28, the first sensor coil 26 and the second sensor coil 28 generate the induced electromotive forces having the waveforms W1 and W2, respectively.

As shown in FIG. 4, when the waveforms W1 and W2 of the first sensor coil 26 and the second sensor coil 28 change from positive to negative with a time t, respectively, the waveforms W1 and W2 of the first sensor coil 26 and the second sensor coil 28 pass points C1 and C2 where voltages of the waveforms W1 and W2 become zero (V0). At the points C1 and C2, the permanent magnet 24 of the club head 18 passes in front of the first sensor coil 26 and the second sensor coil 28. The first sensor coil 26 and the second sensor coil 28 always detect changes in the voltages except a measurement prohibition period.

As described above, in the embodiment, the calculation unit 62 of the golf swing measurement device 10 calculates the head speed, the total flying distance, the swing time, and the swing path. The display unit 30 displays the head speed, the total flying distance, the swing time, and the swing path in a plurality of modes such as a measurement mode, a call mode, and an average mode.

In the measurement mode, when the golfer swings the golf club, the calculation unit 62 calculates the head speed, the total flying distance, the swing time, and the swing path of the gold club. Then, the display unit 30 displays the head speed, the total flying distance, and the swing time for a specific period of time in this sequence. Then, the display unit 30 displays the head speed and stops changing the display. Further, the display unit 30 displays the swing path as an icon in a different space thereof after the measurement.

In the call mode, the display unit 30 displays the latest measurement data of a single swing or a plurality of swings. In the average mode, the display unit 30 displays an average value of the latest measurement data of a plurality of swings.

In the embodiment, the golf swing measurement device 10 can be arranged to measure a swing path of a putter in addition to those of a wooden club and an iron club. Further, the golf swing measurement device 10 can be arranged to switch back and forth between a measurement mode for a left-handed golfer and a measurement mode for a right-handed golfer through a specific operation. Further, the golf swing measurement device 10 can be arranged to switch a unit of the head speed between mph and m/s through a specific operation.

In the embodiment, as shown in FIGS. 1 and 3, the golf swing measurement device 10 is connected to a personal computer 34 through a cable 40 and the data conversion device 42, so that the golf swing measurement device 10 sends the measurement data to the personal computer 34. The golf swing measurement device 10 is connected to the personal computer 34 at a place where the golfer swings the golf club such as a driving range.

Alternatively, the golf swing measurement device 10 is connected to the personal computer 34 at a place other than a driving range such as a home. In this case, after the golf swing measurement device 10 measures the golf swing at the driving range, the golf swing measurement device 10 is moved to a different place such as a home for analyzing the measurement data.

In the embodiment, the cable 40 has a USB mini-B terminal as a connection terminal on a side of the golf swing measurement device 10 and a USB terminal as a connection terminal on a side of the personal computer 34.

In the embodiment, the cable 40 is provided with a data conversion device 42. The data conversion device 42 is provided for converting a TTL signal to a CSV signal. The CSV signal can be sent through the USB terminal and is easy to process. Through the cable 40 described above, when a specific operation is executed in the golf swing measurement device 10, or when an instruction is sent from the personal computer 34, the measurement data stored in the memory unit 64 of the golf swing measurement device 10 are sent to the personal computer 34.

An operation on the personal computer 34 after the golf swing measurement device 10 is connected to the personal computer 34 will be explained next. A special driver and software are installed in the personal computer 34.

Figure 5:
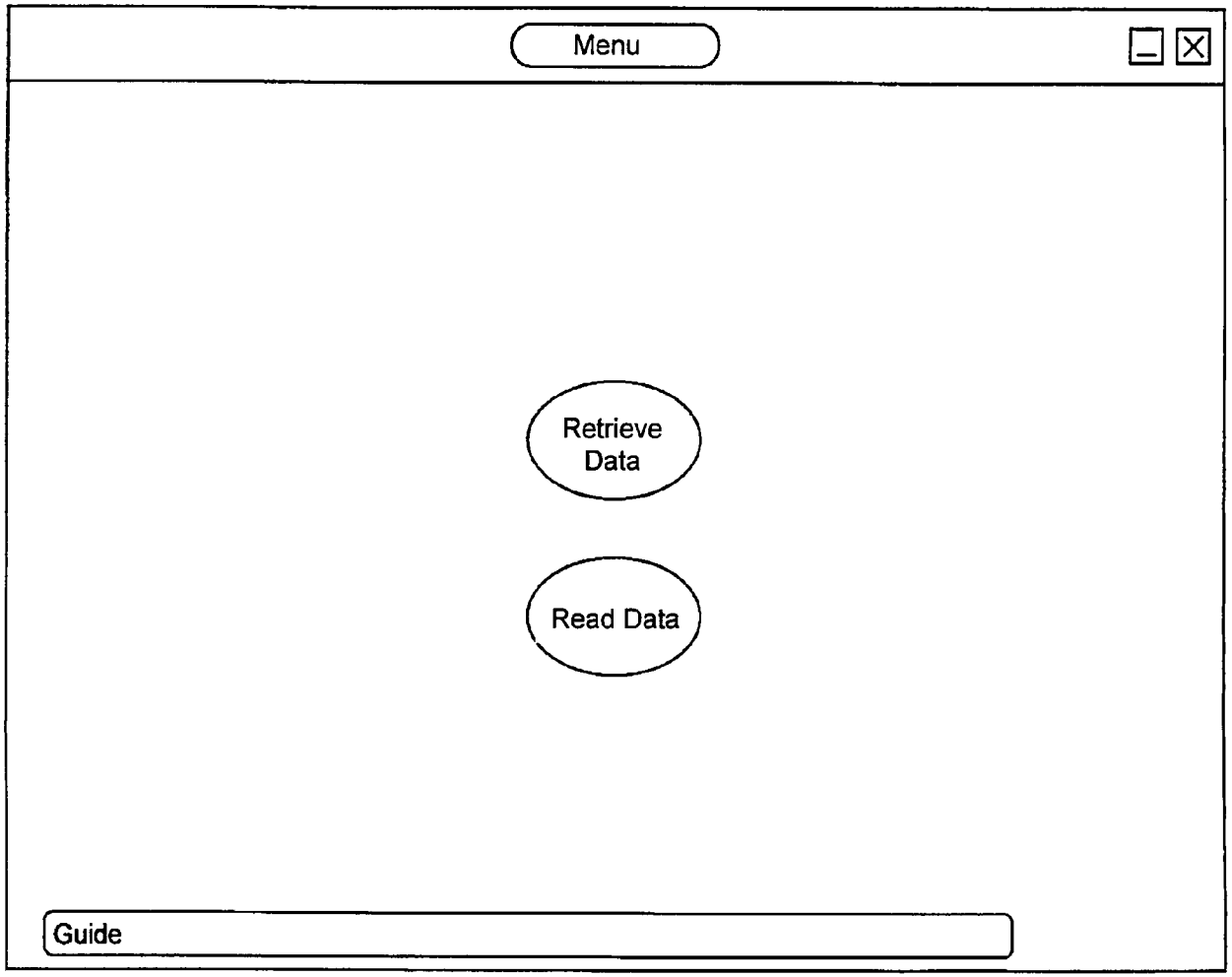
FIG. 5 is a schematic view No. 1 showing a display of a computer according to the first embodiment of the present invention.
Figure 6:
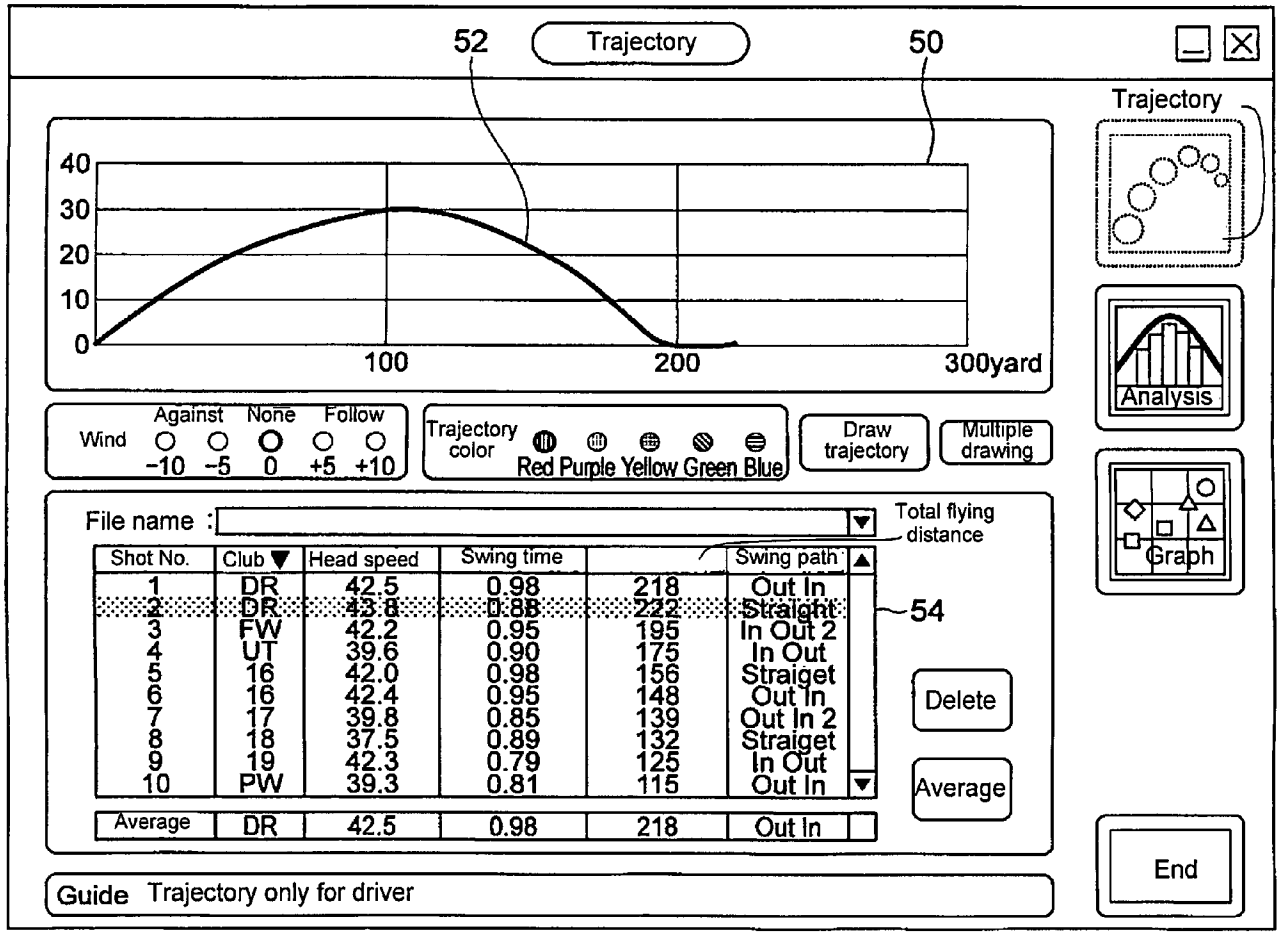
FIG. 6 is a schematic view No. 2 showing the display of the computer according to the first embodiment of the present invention.
Figure 7:
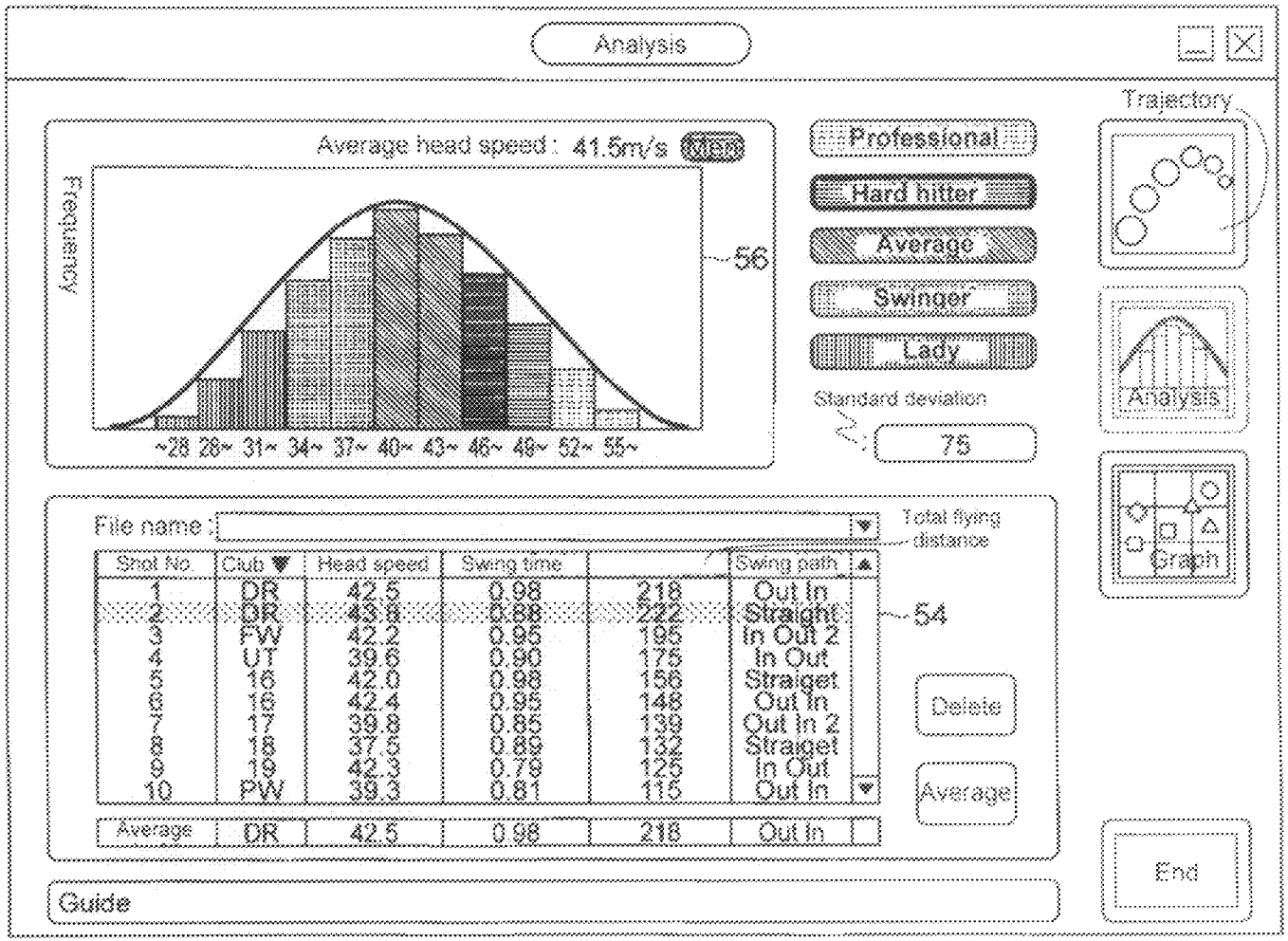
FIG. 7 is a schematic view No. 3 showing the display of the computer according to the first embodiment of the present invention.
Figure 8:
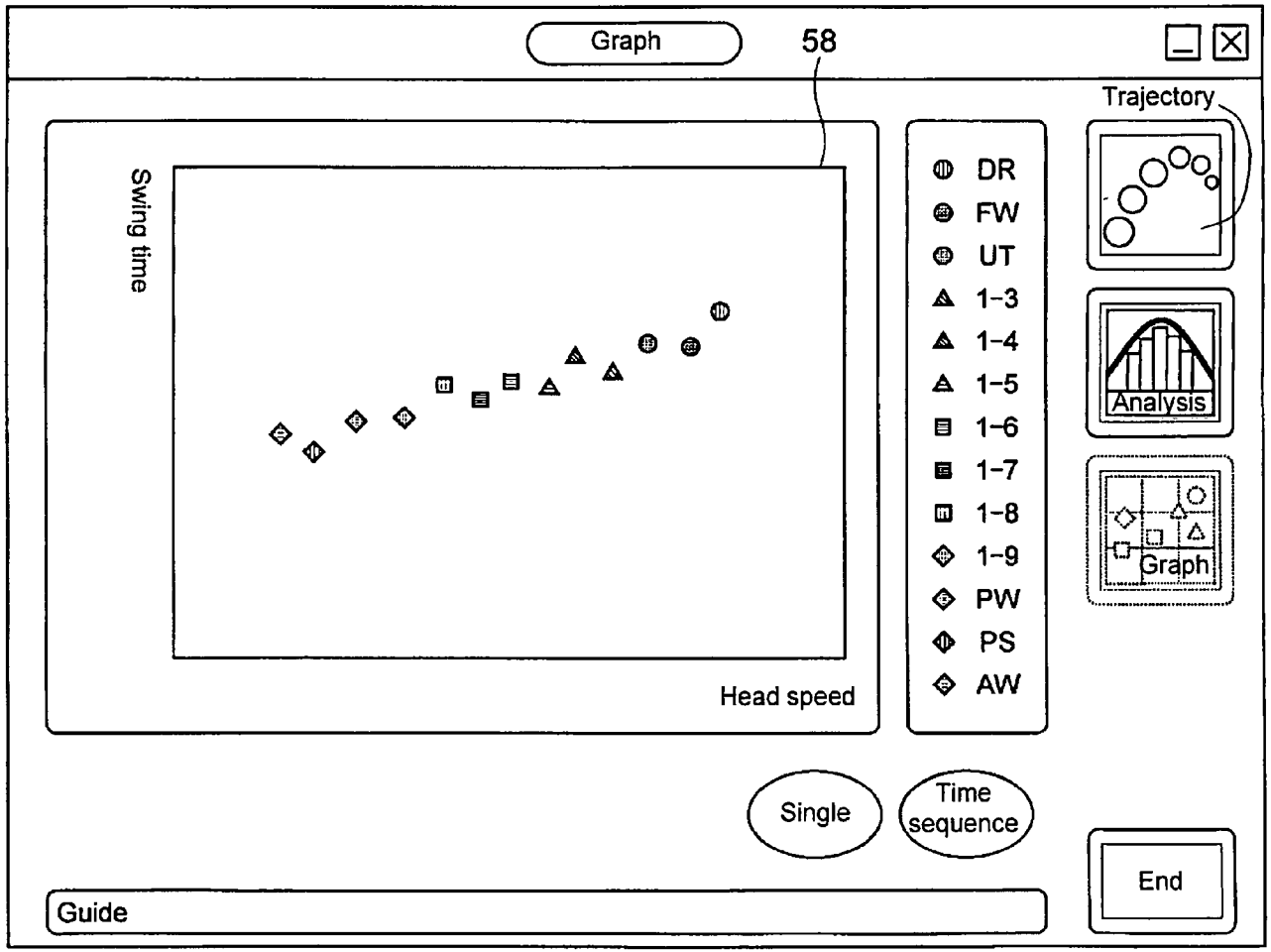
FIG. 8 is a schematic view No. 4 showing the display of the computer according to the first embodiment of the present invention.
Figure 9:
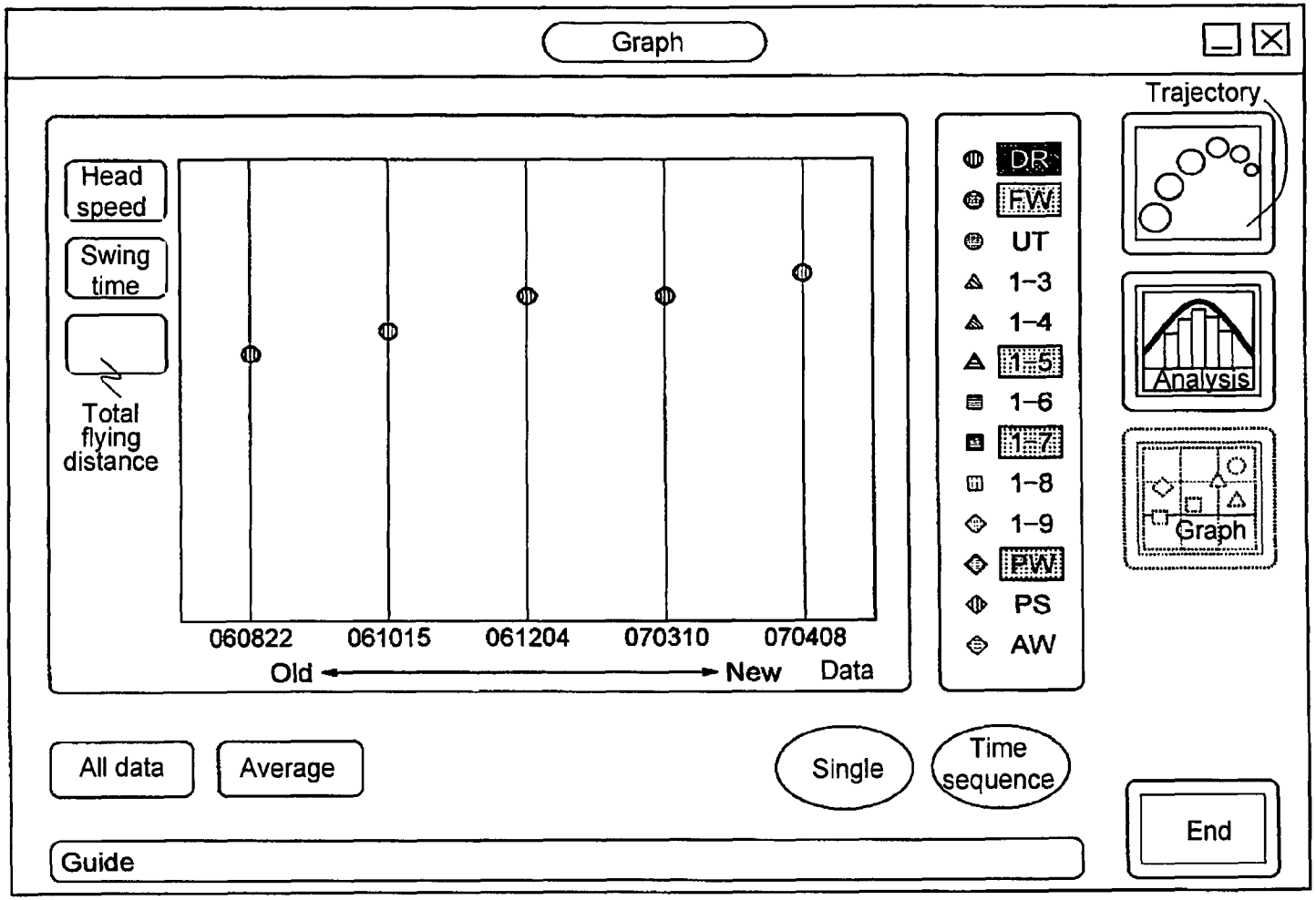
FIG. 9 is a schematic view No. 5 showing the display of the computer according to the first embodiment of the present invention.

FIG. 5 is a schematic view No. 1 showing a display of the personal computer 34 according to the first embodiment of the present invention. FIG. 6 is a schematic view No. 2 showing the display of the personal computer 34 according to the first embodiment of the present invention. FIG. 7 is a schematic view No. 3 showing the display of the personal computer 34 according to the first embodiment of the present invention. FIG. 8 is a schematic view No. 4 showing the display of the personal computer 34 according to the first embodiment of the present invention. FIG. 9 is a schematic view No. 5 showing the display of the personal computer 34 according to the first embodiment of the present invention.

First, the software installed in the personal computer 34 starts up, and a menu screen is displayed as shown in FIG. 5. When a "Retrieve Data" button is clicked, the measurement data stored in the memory unit 64 of the golf swing measurement device 10 are sent to a memory in the personal computer 34. Alternatively, when the golf swing measurement device 10 is switched to a forwarding mode through a button operation, the measurement data are sent to the personal computer 34.

In the next step, the measurement data are stored in a hard disk of the personal computer 34 if necessary. When a "Read Data" button in the menu screen is clicked, the measurement data stored in the hard disk of the personal computer 34 can be read out.

After the measurement data are retrieved, stored, and read, a trajectory screen is displayed as shown in FIG. 6. In the trajectory screen, a trajectory 52 is displayed in a trajectory display area 50. A number of shots (shot number), the head speed, the swing time, the total flying distance, and the swing path are displayed in a measurement data screen 54 below the trajectory display area 50.

When an "Analysis" button is clicked in the trajectory screen, an analysis screen is displayed as shown in FIG. 7. In the analysis screen, a histogram showing a frequency distribution of the head speeds, for example, is displayed in an analysis display area 56 as shown in FIG. 7.

In the analysis screen, when a "Graph" button is clicked, a single graph screen is displayed as shown in FIG. 8. In the single graph screen, a graph, for example, is displayed in a graph display area 58 as shown in FIG. 8. In the graph, a vertical axis represents the swing time, and a horizontal axis represents the head speed.

In the single graph screen, when a "Time Series" button is clicked, a time series graph screen is displayed as shown in FIG. 9. In the time series graph screen, a graph, for example, is displayed as shown in FIG. 9. In the graph, a vertical axis represents the head speed, the swing time, or the total flying distance, and a horizontal axis represents a date.

Note that the display method, the display sequence, and the likes of various measurement data and the graphs can be modified.

Second Embodiment

Figure 10:
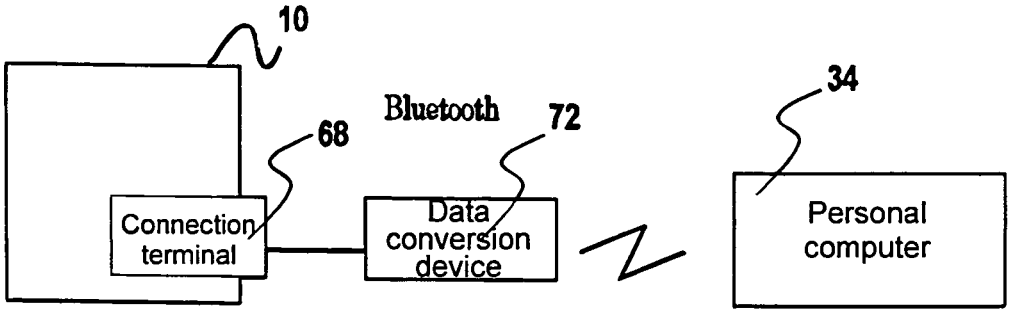
FIG. 10 is a block diagram showing a golf swing measurement device according to a second embodiment of the present invention.

A second embodiment of the present invention will be explained next with reference to FIG. 10. FIG. 10 is a block diagram showing the golf swing measurement device 10 according to the second embodiment of the present invention.

Components in the second embodiment similar to those in the first embodiment are designated by the same reference numerals, and explanations thereof are omitted.

In the second embodiment, the golf swing measurement device 10 is configured such that the golf swing measurement device 10 can be connected to the personal computer 34 or a personal digital assistant (PDA) through Bluetooth connection.

More specifically, when the golf swing measurement device 10 is connected to the personal computer 34 or a personal digital assistant (PDA) through Bluetooth connection, a conversion adapter 72 is connected to the connection terminal 68. In this case, a device such as BT-301 (a product of SMC Networks) is disposed in the conversion adapter 72.

As described above, in the embodiment, it is possible to connect the golf swing measurement device 10 to the personal computer 34 or a personal digital assistant (PDA) through wireless connection, i.e., Bluetooth connection.

Third Embodiment

Figure 11:
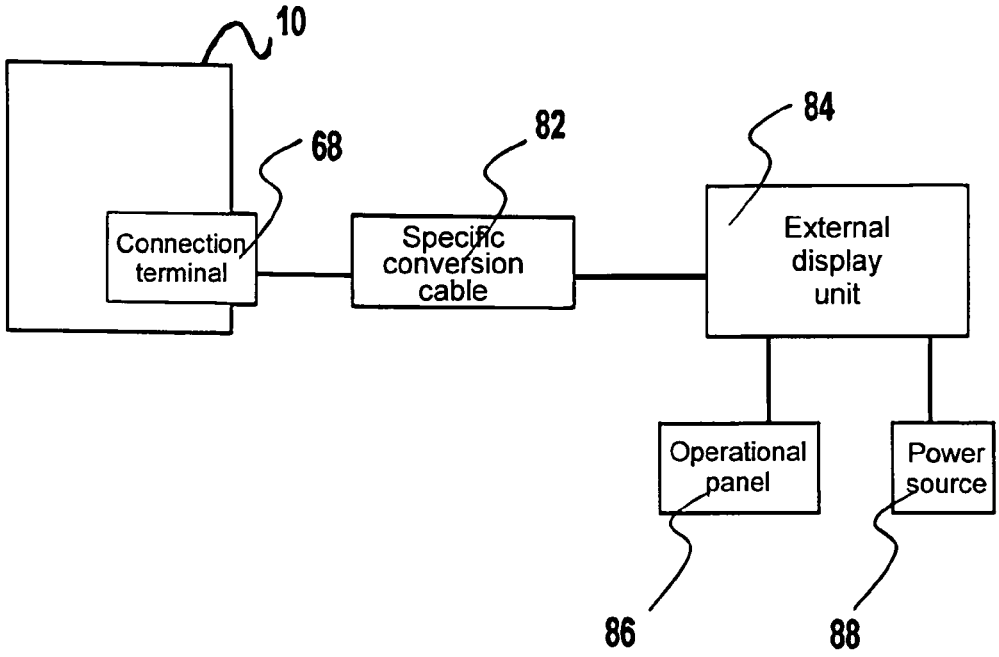
FIG. 11 is a block diagram showing a golf swing measurement device according to a third embodiment of the present invention.

A third embodiment of the present invention will be explained next with reference to FIG. 11. FIG. 11 is a block diagram showing a golf swing measurement device according to the third embodiment of the present invention.

Components in the third embodiment similar to those in the first embodiment are designated by the same reference numerals, and explanations thereof are omitted.

In the third embodiment, the golf swing measurement device 10 is configured such that the golf swing measurement device 10 can be connected to an external display unit 84 through a specific conversion cable 82. The external display unit 84 has a screen larger than that of the display unit 30.

In the embodiment, when the golf swing measurement device 10 is connected to the external display unit 84, a specific communication cable 82 is connected to the connection terminal 68. In this case, a conversion device is disposed in the specific communication cable 82 for converting to an interface signal for long distance communication. Accordingly, it is possible to separate the external display unit 84 from the golf swing measurement device 10 by a long distance.

In the embodiment, the external display unit 84 is connected to an operational panel 86, so that various operations can be performed through the operational panel 86. More specifically, through the operational panel 86, it is possible to turn on or off the golf swing measurement device 10, switch the measurement mode of the golf swing measurement device 10, and change the function of the golf swing measurement device 10.

In the embodiment, the external display unit 84 is further connected to a power source 88 for supplying power to the external display unit 84. Accordingly, it is possible to supply power to the golf swing measurement device 10 from the external display unit 84. As a result, it is possible to eliminate a power source in the golf swing measurement device 10.

The disclosure of Japanese Patent Application No. 2007-131417, filed on May 17, 2007, is incorporated in the application by reference.

While the invention has been explained with reference to the specific embodiments of the invention, the explanation is illustrative and the invention is limited only by the appended claims.

What is claimed is:

1. A golf swing measurement device for measuring a swing path of a club head with a permanent magnet on a distal thereof, comprising:

a housing having a sidewall portion extending substantially in parallel to the swing path;

a first sensor coil disposed along the sidewall portion for detecting the club head passing therethrough;

a second sensor coil disposed along the sidewall portion at a front position of the swing path with respect to the first sensor coil by a specific distance for detecting the club head passing therethrough;

a calculation unit for calculating a swing time from a start moment of a backswing to a moment of an impact, a head speed upon the impact, and a total flying distance according to a detection signal of the first sensor coil and the second sensor coil;

a display unit for displaying the swing time, the head speed, and the total flying distance;

a memory unit for storing measurement data including the swing time, head speed, and the total flying distance; and a transmission unit for sending the measurement data stored in the memory unit externally to an external display unit so that a trajectory of a golf ball is displayed on the external display unit, wherein said first sensor coil and said second sensor coil are configured to be switchable so that the swing path of a right-hand player or a left-hand player can be measured.

2. The golf swing measurement device according to claim 1, wherein said transmission unit is adapted to send the measurement data when a specific operation is executed or an instruction is sent externally.

3. The golf swing measurement device according to claim 1, wherein said display unit is adapted to alternately display the swing time, the head speed, and the total flying distance for a specific period of time in this sequence, and then to continue to display the head speed.

4. The golf swing measurement device according to claim 1, wherein said second sensor coil is arranged away from the first sensor coil by the specific distance in a range of 50 mm to 100 mm.

5. The golf swing measurement device according to claim 1, wherein said memory unit is adapted to store the measurement data including the swing time, the head speed, and the total flying distance for 10 to 200 swings.

6. The golf swing measurement device according to claim 1, wherein said calculation unit is adapted to determine the swing path according to the detection signal, and to classify the swing path into an outside-in, a straight-through, or an inside-out, said display unit displaying the classification of the swing path.

7. The golf swing measurement device according to claim 1, further comprising a communication terminal connected to the transmission unit for sending and receiving a signal.

8. A golf swing measurement system comprising:

a golf swing measurement device for measuring a swing path of a club head with a permanent magnet on a distal thereof, said golf swing measurement device comprising:

a housing having a sidewall portion extending substantially in parallel to the swing path;

a first sensor coil disposed along the sidewall portion for detecting the club head passing therethrough;

a second sensor coil disposed along the sidewall portion at a front position of the swing path with respect to the first sensor coil by a specific distance for detecting the club head passing therethrough;

a calculation unit for calculating a swing time from a start moment of a backswing to a moment of an impact, a head speed upon the impact, and a total flying distance according to a detection signal of the first sensor coil and the second sensor coil;

a display unit for displaying the swing time, the head speed, and the total flying distance;

a memory unit for storing measurement data including the swing time, head speed, and the total flying distance;

a transmission unit for sending the measurement data stored in the memory unit externally to an external display unit so that a trajectory of a golf ball is displayed on the external display unit; and a communication terminal connected to the transmission unit for sending and receiving a signal;

a cable connected to the communication terminal; and a data conversion device connected to the cable.

9. The golf swing measurement device according to claim 1, wherein said transmission unit is configured to send the measurement data stored in the memory unit externally to the external display unit so that a plurality of the trajectories is displayed on the external display unit in different colors.

10. The golf swing measurement device according to claim 1, wherein said transmission unit is configured to send the measurement data stored in the memory unit externally to the external display unit so that the trajectory is adjusted according to a wind direction and displayed on the external display unit.

11. The golf swing measurement device according to claim 1, wherein said transmission unit is configured to send the measurement data stored in the memory unit externally to the external display unit so that a histogram showing a frequency distribution of the head speed is displayed on the external display unit.

12. A golf swing measurement system comprising:

a golf swing measurement device for measuring a swing path of a club head with a permanent magnet on a distal thereof, said golf swing measurement device comprising:

a housing having a sidewall portion extending substantially in parallel to the swing path;

a first sensor coil disposed along the sidewall portion for detecting the club head passing therethrough;

a second sensor coil disposed along the sidewall portion at a front position of the swing path with respect to the first sensor coil by a specific distance for detecting the club head passing therethrough;

a calculation unit for calculating a swing time from a start moment of a backswing to a moment of an impact, a head speed upon the impact, and a total flying distance according to a detection signal of the first sensor coil and the second sensor coil;

a display unit for displaying the swing time, the head speed, and the total flying distance;

a memory unit for storing measurement data including the swing time, head speed, and the total flying distance;

a transmission unit for sending the measurement data stored in the memory unit externally; and a communication terminal connected to the transmission unit for sending and receiving a signal;

a cable connected to the communication terminal;

a data conversion device connected to the cable; and an external display unit connected to the cable through the data conversion device for displaying a trajectory of a golf ball.

13. The golf swing measurement system according to claim 12, further comprising a power source connected to the external display unit and an operational panel connected to the external display unit.

* * * * *